US010532235B2

(12) United States Patent
Linton

(10) Patent No.: US 10,532,235 B2
(45) Date of Patent: Jan. 14, 2020

(54) GRID MESH ANCHOR

(71) Applicant: GRIDMESH ANCHOR PTY LTD, Longueville, NSW (AU)

(72) Inventor: Stephen Linton, Jindalee (AU)

(73) Assignee: GRIDMESH ANCHOR PTY LTD, Longueville, NSW (AU)

( * ) Notice: Subject to any disclaimer, the term of this patent is extended or adjusted under 35 U.S.C. 154(b) by 27 days.

(21) Appl. No.: 15/575,129

(22) PCT Filed: Jun. 16, 2016

(86) PCT No.: PCT/AU2016/050511
§ 371 (c)(1),
(2) Date: Nov. 17, 2017

(87) PCT Pub. No.: WO2016/201518
PCT Pub. Date: Dec. 22, 2016

(65) Prior Publication Data

US 2018/0140876 A1 May 24, 2018

(30) Foreign Application Priority Data

Jun. 19, 2015 (AU) ..... 2015902375

(51) Int. Cl.
*A62B 35/00* (2006.01)
*E04G 21/32* (2006.01)
*E04B 1/38* (2006.01)

(52) U.S. Cl.
CPC ..... *A62B 35/0068* (2013.01); *E04G 21/3276* (2013.01); *E04B 1/38* (2013.01); *E04B 2001/405* (2013.01)

(58) Field of Classification Search
CPC .. A62B 35/0068; E04B 1/38; E04B 2001/405
(Continued)

(56) References Cited

U.S. PATENT DOCUMENTS 1,285,202 A * 11/1918 Jaques ..... E04B 1/4121 248/343
2,277,449 A * 3/1942 Paine ..... E04B 1/415 52/706

(Continued)

FOREIGN PATENT DOCUMENTS

DE 102012105985 9/2014
WO WO2014/166177 10/2014

OTHER PUBLICATIONS

Written Opinion I of PCT/AU2016/050511, dated Aug. 22, 2016.

(Continued)

*Primary Examiner* — Colleen M Chavchavadze
(74) *Attorney, Agent, or Firm* — Workman Nydegger

(57) ABSTRACT

The present invention concerns an anchor assembly for providing a secure point of attachment at a grid mesh platform. The anchor assembly comprises a housing in the form of an elongated case with a central hollow channel, generally rectangular in shape with a flat base and roof. The base includes openings in the form of access slots to provide access from the channel to the exterior of the base. The anchor assembly also comprises a suspension member located within the channel. In operation the anchor assembly spans adjacent structural members underlying the mesh grid. A coupling member in the form of a sling having an end loop is engaged by the suspension member which passes through the end loop of the sling. The sling also passes through one of the slots in the base of the elongated case. An opposite end of the sling provides an anchor point.

14 Claims, 5 Drawing Sheets

(58) Field of Classification Search
USPC ..... 248/317, 343; 52/698, 706
See application file for complete search history.

(56) References Cited

U.S. PATENT DOCUMENTS 2,499,791 A * 3/1950 Spencer ..... A47B 51/00 312/247
2,583,613 A * 1/1952 Talbott ..... A47L 3/00 49/465
2,614,785 A * 10/1952 Versen ..... F21V 21/04 248/27.1
3,077,328 A * 2/1963 Nelson ..... B64D 1/06 248/317
3,201,077 A * 8/1965 Heimann ..... A22C 15/00 248/307
3,518,421 A * 6/1970 Cogdill ..... F21V 21/02 211/105.3
3,550,343 A * 12/1970 Buske ..... E04B 1/4142 410/112
3,614,046 A * 10/1971 Lehman ..... F21V 21/02 248/343
3,944,219 A * 3/1976 LoPresti ..... A63B 1/00 482/38
4,436,335 A * 3/1984 Yoos ..... B60N 3/104 114/191
4,463,923 A * 8/1984 Reiker ..... E04B 9/006 248/27.1
5,011,106 A * 4/1991 Cody ..... A62B 35/0068 182/3
5,150,868 A * 9/1992 Kaden ..... H02G 3/126 248/200.1
5,393,026 A * 2/1995 Deschamps ..... H02G 3/125 248/343
5,535,852 A * 7/1996 Bishop ..... B66B 9/00 187/336
5,687,535 A * 11/1997 Rohlf ..... A62B 35/0068 52/713
5,720,461 A * 2/1998 Kerr, Jr. ..... E04B 9/006 248/217.3
5,730,245 A * 3/1998 Conway ..... E04G 21/3276 182/3
5,758,743 A * 6/1998 Coyle ..... A62B 35/0068 182/45
6,123,154 A * 9/2000 MacDonald ..... A62C 35/68 169/16
6,233,877 B1 * 5/2001 Monroe ..... A62B 1/04 182/230
6,739,096 B2 * 5/2004 Feldpausch ..... F16M 11/08 248/327
7,364,016 B2 * 4/2008 Drummond ..... A62B 1/04 182/3
7,429,025 B1 * 9/2008 Gretz ..... H02G 3/20 248/200.1
7,575,098 B2 * 8/2009 Hartley ..... B66B 9/00 187/261
7,631,849 B2 * 12/2009 Chen ..... F04D 25/088 220/3.9
7,753,334 B2 * 7/2010 Schreiber ..... E04G 21/3261 248/351
7,883,067 B2 * 2/2011 Walters ..... F16M 11/08 248/317
7,967,272 B2 * 6/2011 Nilsen ..... E04B 9/006 248/214
8,025,125 B2 * 9/2011 Vetesnik ..... A62B 1/04 182/45
8,096,384 B2 * 1/2012 Caylor ..... A62B 1/04 182/3
9,216,307 B2 * 12/2015 Liu ..... E04G 21/32
9,238,155 B2 * 1/2016 Borchardt ..... A62B 35/0068
9,359,779 B2 * 6/2016 Borchardt ..... E04G 21/3295
9,420,881 B2 * 8/2016 Reid ..... A47B 46/005
9,611,664 B2 * 4/2017 Tsaousis ..... E04G 21/3242
9,868,006 B1 * 1/2018 Epler ..... A63B 1/00
9,878,187 B2 * 1/2018 Sargent ..... E04G 21/328
10,208,492 B2 * 2/2019 Mayer ..... E04B 1/4142
2006/0242924 A1 * 11/2006 Kwon ..... E04B 1/4142 52/704
2009/0205904 A1 * 8/2009 Appl ..... E04G 21/3276 182/3
2010/0187040 A1 * 7/2010 Siemienowicz ..... A62B 1/04 182/3
2011/0265296 A1 11/2011 Perkins
2012/0067668 A1 * 3/2012 Rico ..... A62B 35/0068 182/3

OTHER PUBLICATIONS

Written Opinion II of PCT/AU2016/050511, dated May 1, 2017.
International Search Report of PCT/AU2016/050511, dated Aug. 22, 2016.
IPRP of PCT/AU2016/050511, dated Aug. 7, 2017.

* cited by examiner

GRID MESH ANCHOR

The present application is a U.S. National Stage of International Application No. PCT/AU2016/050511, filed on Jun. 16, 2016, designating the United States and claiming the priority of Australian Patent Application No. 2015902375 filed with the Australian Patent Office on Jun. 19, 2015. All of the aforementioned applications are incorporated herein in their respective entireties by this reference.

FIELD OF THE INVENTION

The present invention relates broadly to an anchor assembly and relates particularly, although not exclusively, to a grid mesh anchor assembly.

BACKGROUND

In various industries it is sometimes required for a worker to perform operations at great heights. Working at heights creates the obvious risk of falling and subsequent injury, possibly fatal, to the worker. Accordingly, many safety devices and methods must be in place and adhered to, to reduce the risk of injury to workers at heights.

It is common to require workers at heights to wear fall arrest equipment, such as a harness, to suspend from to perform work or to prevent them from falling large distances and sustaining significant injury. The harness worn by the worker clearly needs to be attached to a suitable anchor point capable of supporting a fall arrest load, either directly or indirectly through additional straps and various other devices, such as inertia reels. The fall arrest load rating requirements vary between different countries, however are a minimum of 15 kN (approximately 1.5 tonne) and up to 22.2 kN (approximately 2.2 tonne) in other locations, for a single person.

A commonly used point of attachment for fall arrest equipment on steel structures for maintenance is merely using a scaffold tube for an anchorage strap to pass over. The scaffold tube used is of a length allowing it to span two I-beams, with grid mesh above to provide adequate support. To prevent the scaffold tube being accidentally moved and thereby not safely anchoring a worker, scaffold fittings are placed at either end of the tube.

This method of anchoring a worker presents a significant trip hazard for those at the level of the scaffold tube. Further, it is not safety rated (or independently certified) and spanning the two I-beams is vital to ensure the load is being carried by the beams rather than merely the grid mesh.

SUMMARY OF THE INVENTION

In accordance with the present invention there is provided an anchor assembly comprising:

an elongate housing including a base;

a suspension member located within the elongate housing;

at least one opening provided in the base of the elongate housing whereby a coupling member is adapted to pass through the opening and engage the suspension member for suspension of the coupling member from the suspension member;

a pair of feet located at or proximal respective of opposing ends of the base of the elongate housing, the suspension member located above the pair of feet so that load imparted on the suspension member via the coupling member is transferred to the pair of feet.

Preferably the housing is in the form of a substantially enclosed case comprising the base and a roof configured to enclose the suspension member. More preferably the enclosed case comprises a pair of each of side and end walls that taper from the roof downward and outward toward the base. Even more preferably the roof is openable for access to an interior of the elongated case.

Preferably the opening is in the form of an access slot in the base.

Preferably the suspension member is in the form of an elongated rod or tube. More preferably the suspension member occupies substantially the full length of the elongated case. Even more preferably the elongated case is generally rectangular in shape.

Preferably the anchor assembly also comprises a plurality of straps for releasably securing the suspension member within the housing.

Preferably the housing comprises one or more securement points adapted for securing the anchor assembly to an associated structure from which the coupling member is to be suspended.

Preferably the anchor assembly is adapted to locate on an upper side of a grid mesh supported by one or more underlying structural members. More preferably the location of the anchor assembly ensures the suspension member spans at least two adjacent of the structural members.

Preferably the feet are adapted to rest upon the grid mesh above the underlying structural members to transfer forces from the suspension member to said structural members via the feet.

Preferably the coupling member is in the form of a sling through which the suspension member passes for engagement. Alternatively the coupling member is in the form of a flexible rope, wire or cable.

Preferably the coupling member attaches to a safety fall device such as an inertia reel. Alternatively the coupling member attaches to a device such as a chain block.

Preferably the anchor assembly is to be rated to 22.2 kN (5000 lbs) as a personal fall arrest anchorage.

BRIEF DESCRIPTION OF DRAWINGS

In order to achieve a better understanding of the nature of the present invention a preferred embodiment of an anchor assembly will now be described, by way of example, with reference to the accompanying drawings, in which.

DESCRIPTION OF PREFERRED EMBODIMENTS

Referring to the Figures, there is shown an anchor assembly 10, for providing a secure point of attachment, preferably at a grid mesh platform 12. The secure point of attachment may be used for connection with a harness worn by a user working at heights, or supporting materials handling equipment such as chain blocks, gin wheels, or other hauling or lifting devices.

Figure 1:
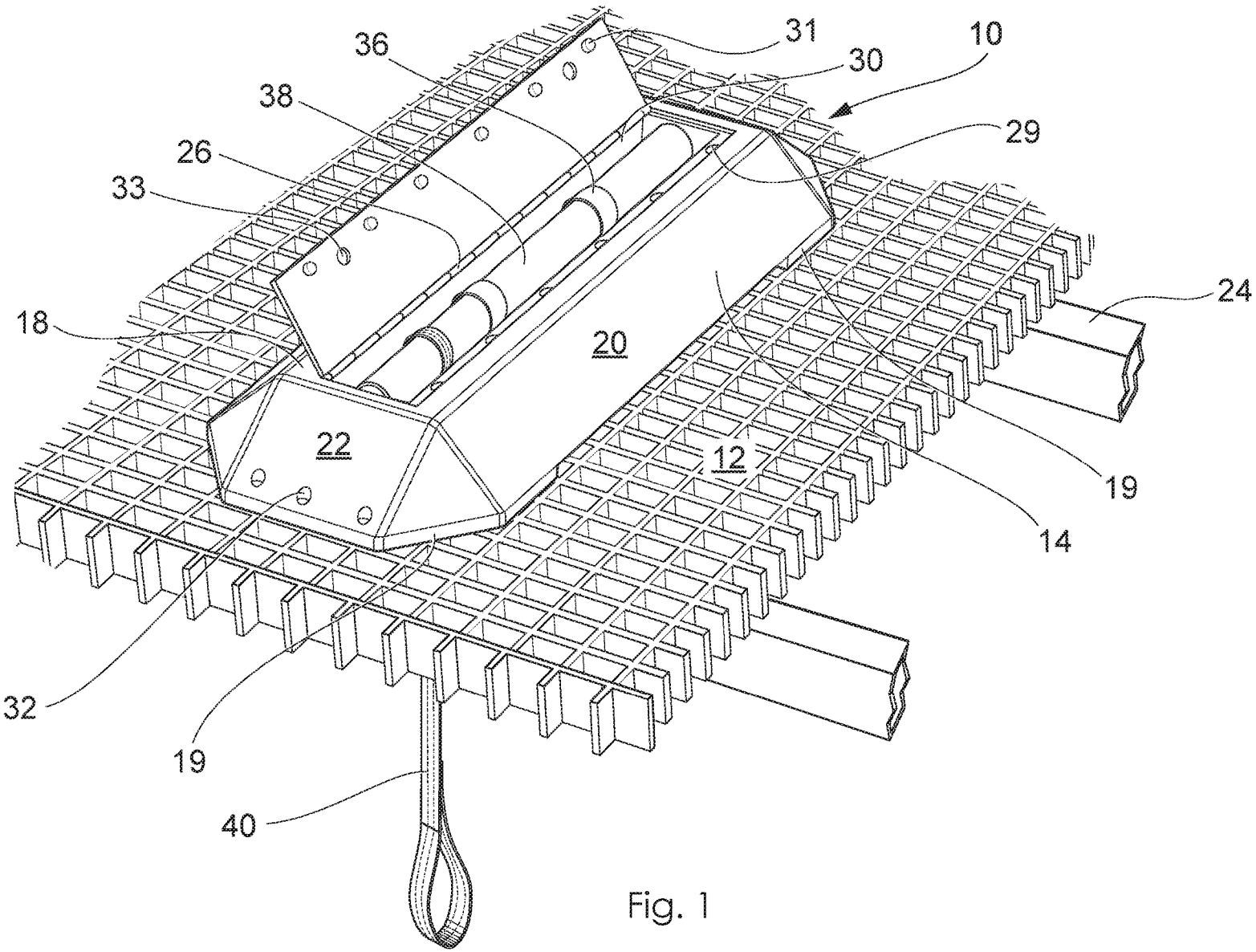
FIG. 1 is an upper perspective view of a grid mesh anchor assembly on top of a grid mesh platform showing a coupling member in engagement with the suspension member according to one embodiment of the invention.

With specific reference to FIG. 1, the anchor assembly 10 comprises a housing in the form of an elongated case 14 with a central hollow channel 30, generally rectangular in shape with a flat base 16 and roof 18. The base 16 is provided with feet 19 at each end of the elongated case 14. The remaining four walls, being the two side walls 20 and two end walls 22 are sloped to create walls that taper downward and outward from the roof 18 to the base 16. All outer surfaces of the case 14 are preferably provided with ridges or other similar means for providing enhanced grip between the case 14 and abutting surfaces. Also, the outer surfaces of the case 14 are preferably coloured to provide enhanced visibility for safety of use, for example, brightly coloured stripes.

The roof 18 is in connection with one side wall 20 through a hinge 26. Accordingly, the roof 18 is able to be rotated about the hinge 26 so that access to the interior of the anchor assembly 10 is enabled. On the same side wall 20 as the hinge 26 is provided a handle 28 for providing a means for carrying the anchor assembly 10. Preferably, the handle 28 is provided as a rectangular aperture and is disposed near a lower edge of the side wall 20 at the centre of the anchor assembly 10. On the side wall 20 opposite the hinge 26 may be provided a means for releasably securing the roof 18 in its closed orientation. In this embodiment this securing means includes holes 29 in the casing 14 arranged to line up with nipples 31 or another detent-style mechanism to assist in securing the roof 18 closed. The roof 18 may also include two small holes 33 provided for finger access and opening of the roof 18.

A lower edge of each end wall 22 is provided with securement points in the form of eyelets 32. The eyelet 32 comprises an aperture and provides a point of attachment of an additional means (including but not limited to the use of cable ties) for securing the anchor assembly 10 in place at the grid mesh 12. The eyelets are sufficiently large in diameter for a karabiner to fit through should the anchor assembly 10 need to be raised by rope or other device.

Figure 3:
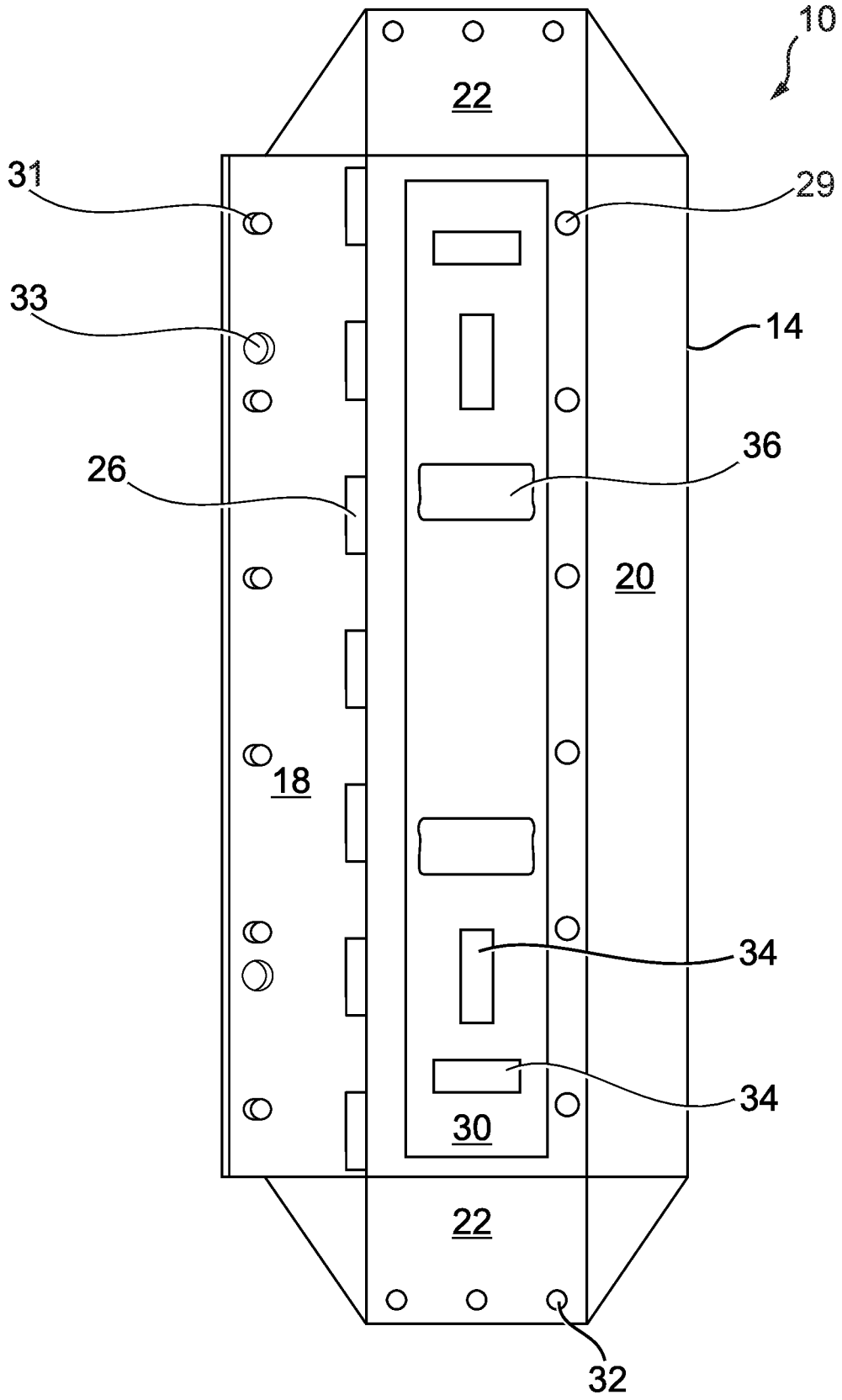
FIG. 3 is an upper plan view of the anchor assembly of the preceding Figures with the roof opened with the suspension member removed.
Figure 4:
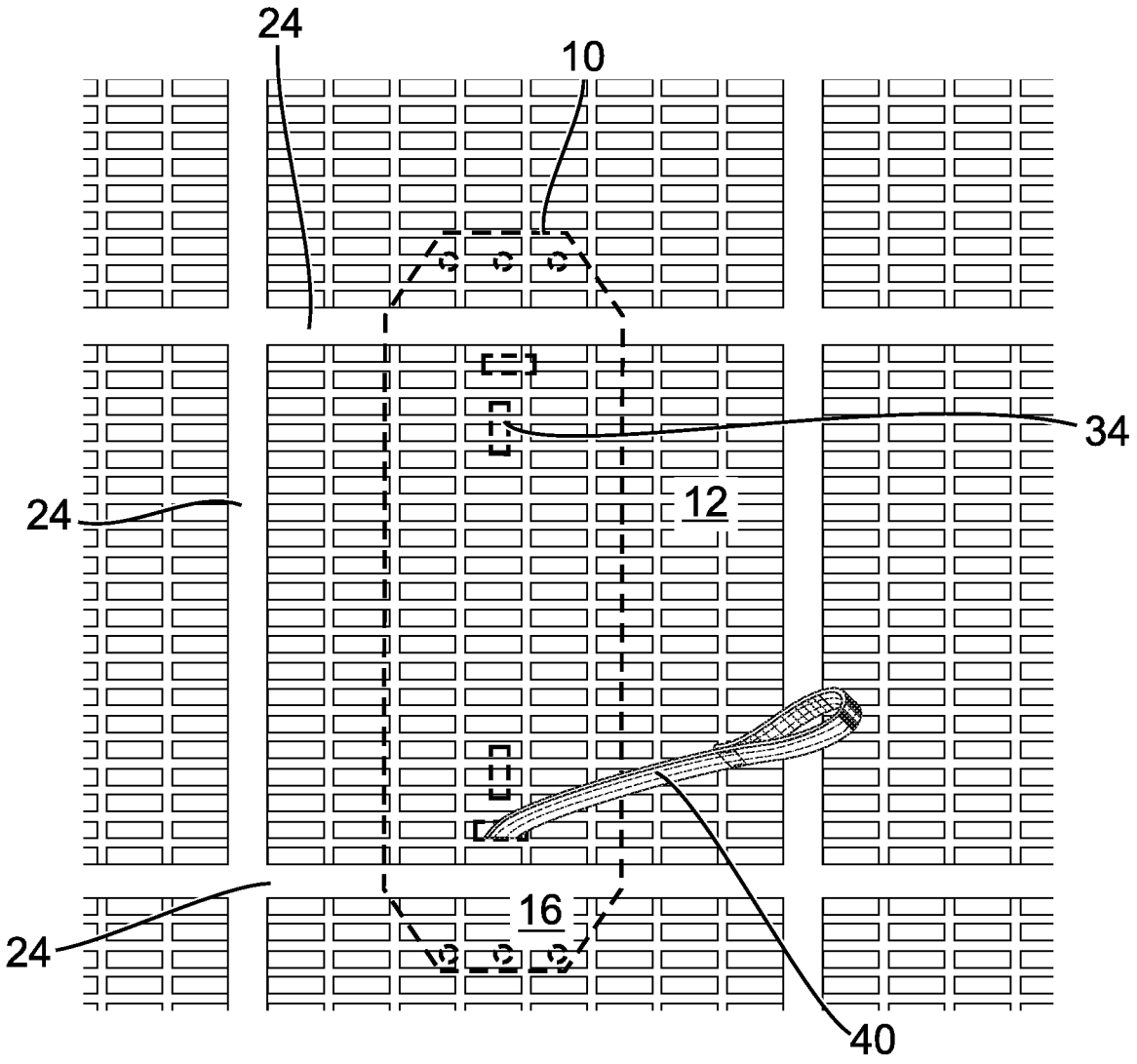
FIG. 4 is an underneath view of the anchor assembly of FIG. 1 showing the coupling member exiting the grid mesh platform.

FIG. 3 shows the roof 18 rotated about the hinge 26 and in an opened orientation. Running a majority of the central length of the anchor assembly 10 is the channel 30. In this example, the channel 30 is dimensioned about 1300 mm in length, 70 mm in width and 80 mm in height although it will be appreciated that the dimensions may vary depending on the application.

The base 16 of the anchor assembly 10 is in this embodiment provided with openings in the form of four access slots 34 (see FIG. 3). The access slots 34 are provided as cut-outs in the base 16 of the anchor assembly 10 providing access from the channel 30 to the exterior of the base 16 of the anchor assembly 10. It is preferred that the access slots 34 are generally rectangular in shape with a pair of slots 34 located proximal each end of the anchor assembly 10. In this example one of each of the pair of slots 34 is oriented lengthways in alignment with the channel 30 whereas the other of the pair of slots 34 is substantially perpendicular to the length of the channel 30. It is preferred that all of the slots 34 are generally central with respect to the width of the channel 30.

Figure 2:
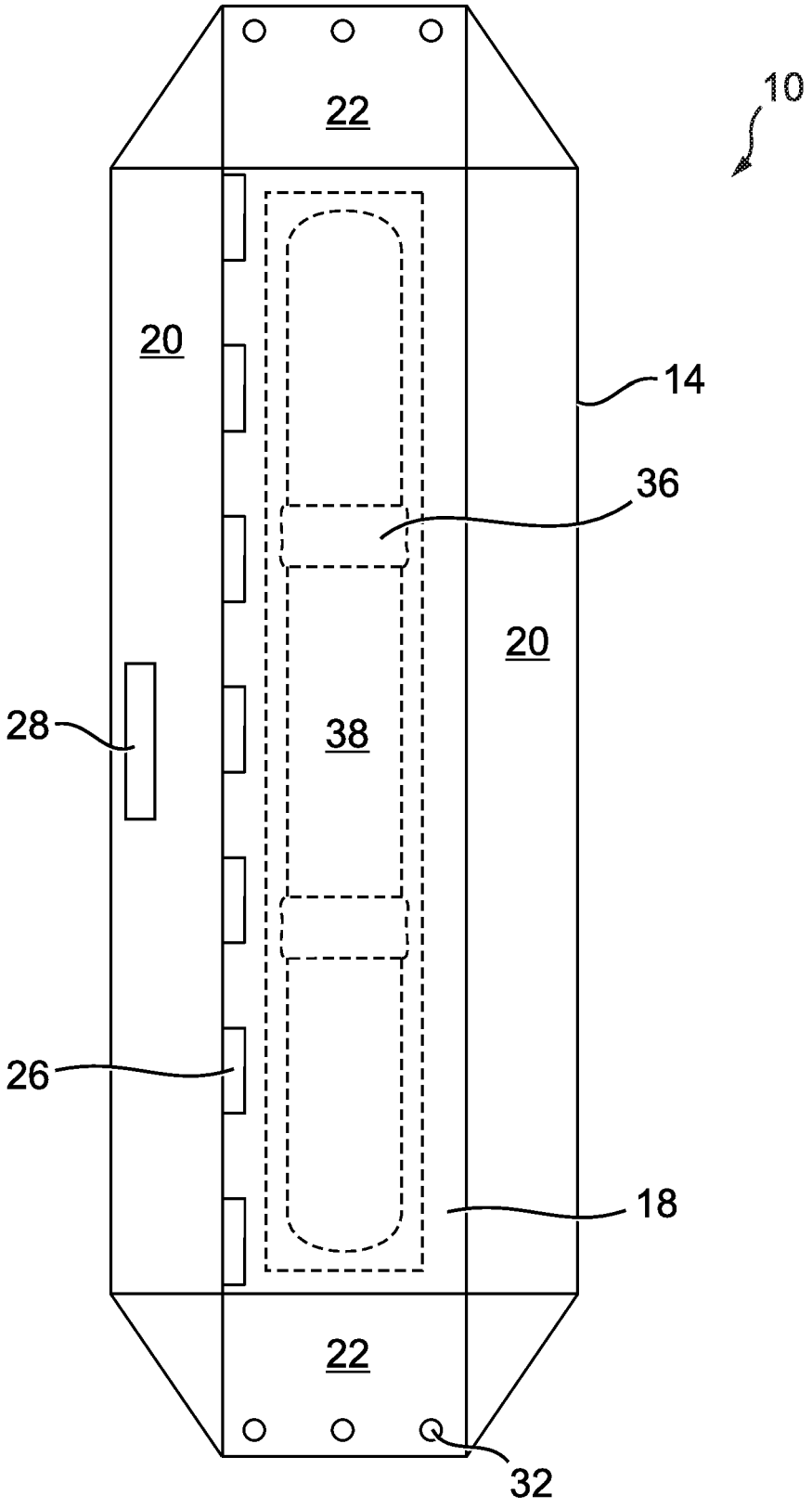
FIG. 2 is an upper plan view of the anchor assembly of FIG. 1.

Provided in the channel 30 are a plurality of straps 36 for temporarily securing a suspension member (as seen in FIG. 2) in the form of a suspension tube 38 in place within the channel 30. The straps 36 may be constructed from hook and eye fabric for easy securing and releasing of the suspension member 38. The straps are securely fastened to the inside base 16 of the anchor assembly 10.

The anchor assembly 10 comprises the suspension member 38 disposed within the channel 30 as best seen in FIG. 1. Preferably, the suspension member 38 is provided as a custom tube rated to withstand predetermined forces depending on the application and typically as prescribed by the relevant statutory safety standard. The suspension member may also be of a commonly available size and depending on the mechanical design requirements be solid in the form of rod. As provided above, the suspension member 38 is securely held in place within the channel 30 by the straps 36. The suspension member 38 of this embodiment occupies substantially the full length of the channel 30.

In use, the anchor assembly 10 may be manually carried to a preferred location using the handle 28. If the suspension member 38 is already provided within the anchor assembly 10, the straps 36 are fastened over the suspension member 38 to ensure it remains in position while the anchor assembly 10 is transported. Once in place, the anchor assembly 10 is positioned flat on its base 16 above a grid mesh 12 at a suitable location so as to provide an optimal anchor point for a user of the anchor assembly 10 for working at height. Ideally, the anchor assembly 10 is positioned such that the feet 19 contact the grid mesh 12 directly over the underlying beams 24. The anchor assembly 10 thus spans the two beams 24 and the weight imposed by a user, for example in the event of a fall, is distributed evenly to the beams 24 below via the feet 19. The suspension member 38 is located above the feet 19 so that any load imparted on the member 38 via a coupling member (such as a sling attached to a user via an inertia reel) is transferred to the feet 19.

Figure 5:
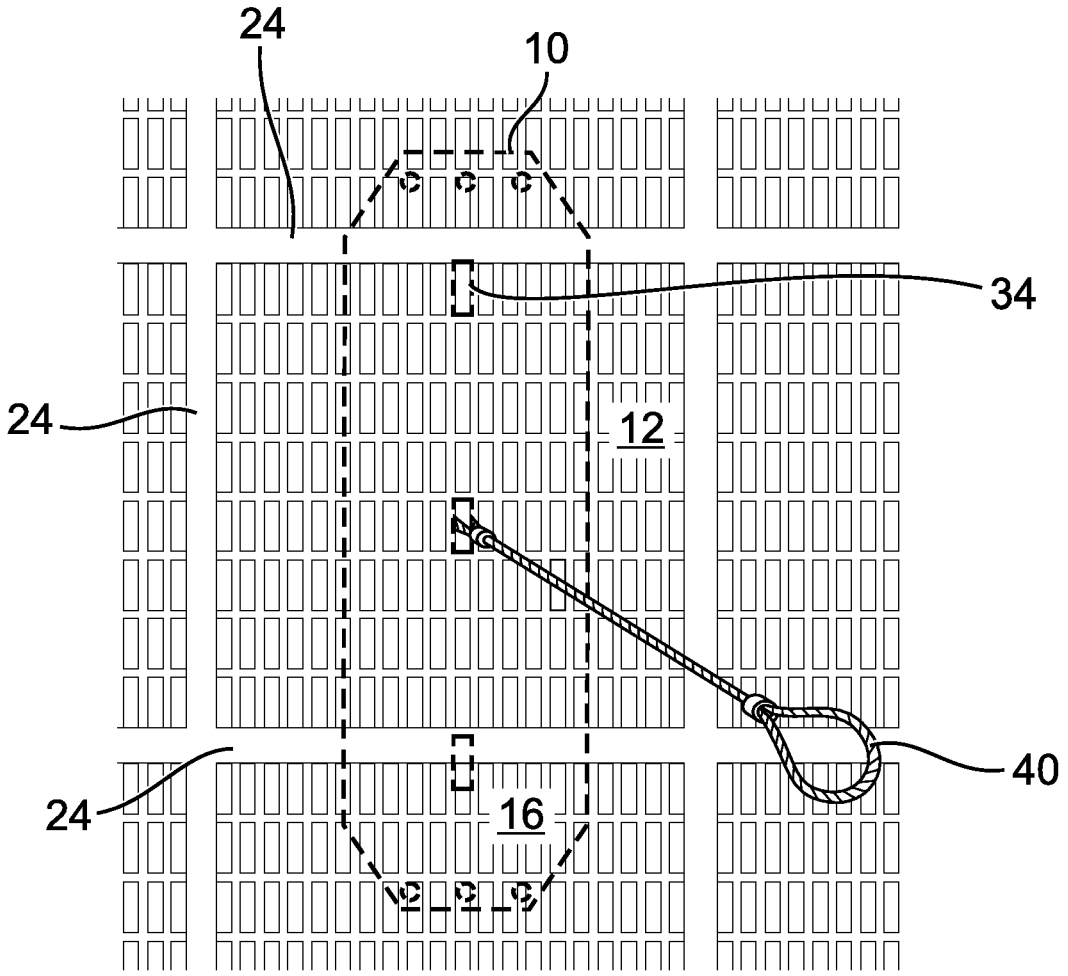
FIG. 5 is a lower perspective view of an anchor assembly of an alternative embodiment located on a grid mesh platform, with a coupling member secured thereto.

FIG. 5 is another embodiment of the anchor assembly 10 oriented at a different angle to the underlying mesh 12. For ease of reference the corresponding components of this and the earlier embodiment have been designated with the same reference numerals. The anchor assembly 10 in this alternative example includes only three longitudinal slots 34 in its base 16 including the slot 34 located midway along the housing or casing 14 and engaging the suspension member 38 midway along its length.

The roof 18 is rotated about the hinge 26 so that the channel 30 at the interior of the case 14 may be easily accessed. If already positioned, the suspension member 38 is temporarily removed from the channel 30 after unfastening the straps 36 to allow for said removal. To provide additional securing of the anchor assembly 10 in its desired location, the eyelet/s 32 are utilised. Additional attachment means, for example cable ties, are passed through the eyelet 32 and the grid mesh 12 so as to reduce the risk of major unwanted movement of the anchor 10 from its desired position.

With the roof 18 remaining in its opened orientation, a rope (not shown) is lowered from above through a slot 34 and through the grid mesh 12 to where a coupling member in the form of a sling 40 (with an attached inertia reel, not shown) is ready Δn end loop of the sling 40 is attached to the rope by any suitable means so that when the rope is raised, the sling 40 follows. Accordingly, with the raising of the rope, the sling is raised through the grid mesh 12 from its underside and through the slot 34 into the channel 30 and the rope removed from the sling 40.

An end of the suspension member 38 is passed through the end loop of the sling 40 and the suspension member 38 is returned to the channel 30. The straps 36 may be fastened over the suspension member 38, and the roof 18 returned to its closed orientation, if desired. Accordingly, the sling 40 is suspended from the suspension member 38 and an opposite end of the sling 40 (to that end in connection with the anchor assembly 10) is attachable to a worker wearing a harness, for example. With the sling 40 secured to the anchor assembly 10, working at heights, lifting, etc. may proceed safely.

Once work is completed and the anchor assembly 10 is no longer required at the location, the webbing anchorage device 40 or other coupling member is removed from the anchor assembly 10 by merely reversing the installation process. That is, the roof 18 is moved to its opened orientation, the straps 36 are unfastened if required and the suspension member 38 is removed from the channel 30 and the sling 40 slipped off an end of the suspension member 38. The additional attachment means, e.g. cable ties, are cut and removed from the eyelet/s 32 and the handle 28 is utilised to move the anchor assembly 10 to another location as required.

Now that several preferred embodiments of the anchor assembly have been described it will be apparent to those skilled in the art that the anchor assembly of these embodiments has at least the following advantages:

1. the anchor assembly including the housing in the form of the elongated case is designed to minimise the risk of a trip hazard;
2. installation of the anchor assembly is relatively quick and easy;
3. installation of the anchor assembly can be performed upon for example the grid mesh platform without exposing the user to dangers associated with working at heights;
4. the anchor assembly can be safely installed directly above a work area enabling personnel to work in full restraint as soon as they leave the ground;
5. the anchor assembly in its application as a safety fall device is designed to be rated as a personal fall arrest anchorage complying with the requisite standards in Australia and overseas.

Other embodiment anchor assemblies 10 are also contemplated in accordance with the present invention. For example, the straps 36 may be provided as any suitable securing means, for example buckled belts or cable ties, providing a means for securing the suspension member 38 within the channel 30. Alternatively the straps may be omitted from the anchor assembly. The openings in the housing of the anchor assembly are not limited to slots which are of a convenient shape when using webbing slings but may extend to other opening shapes. The coupling member is not limited to slings fabricated in webbing but extend to wire, cable, rope or other flexible members of sufficient weight-bearing capacity. Further, while the anchor assembly 10 is preferably used upon a grid mesh 12, anywhere an anchor assembly 10 is required for safety in working at heights, for example on scaffolding, or alternatively for materials handling, the present invention may be utilised.

Modifications and variations as would be apparent to a skilled addressee are deemed to be within the scope of the present invention.

The invention claimed is:

1. A grid mesh anchor assembly comprising:

an elongate housing including a base;

a suspension member located entirely within the elongate housing;

at least one opening provided in the base of the elongate housing;

a flexible coupling member passing through the opening and engaging the suspension member for suspension of the flexible coupling member from the suspension member, the flexible coupling member capable of passing through a grid mesh supported by at least two adjacent structural members underlying the grid mesh;

a pair of feet located at respective opposing ends of the base of the elongate housing and capable of locating on an upper side of the grid mesh, the suspension member located above the pair of feet so that load imparted on the suspension member via the flexible coupling member is transferred to the pair of feet and the upper side of the grid mesh; and the elongate housing is in the form of a substantially enclosed case comprising the base and a roof configured to enclose the suspension member, and the roof is openable for access to an interior of the substantially enclosed case.

2. A grid mesh anchor assembly as claimed in claim 1 wherein a location of the grid mesh anchor assembly ensures the suspension member is capable of spanning said at least two adjacent structural members.

3. A grid mesh anchor assembly as claimed in claim 2 wherein the pair of feet are capable of resting upon the grid mesh above the underlying structural members to transfer forces from the suspension member to said structural members via the pair of feet.

4. A grid mesh anchor assembly as claimed in claim 1 wherein the substantially enclosed case also comprises a pair of each of side and end walls that taper from the roof downward and outward toward the base.

5. A grid mesh anchor assembly as claimed in claim 1 wherein the opening in the base is in the form of an access slot in the base.

6. A grid mesh anchor assembly as claimed in claim 1 wherein the suspension member is in the form of an elongated rod or tube.

7. A grid mesh anchor assembly as claimed in claim 6 wherein the rod or tube occupies substantially a full length of the elongate housing.

8. A grid mesh anchor assembly as claimed in claim 1 also comprising a plurality of straps for releasably securing the suspension member within the elongate housing.

9. A grid mesh anchor assembly as claimed in claim 1 wherein the elongate housing comprises one or more securement points capable of securing said grid mesh anchor assembly to an associated structure from which the flexible coupling member is capable of being suspended.

10. A grid mesh anchor assembly as claimed in claim 1 wherein the flexible coupling member is in the form of a sling through which the suspension member passes for engagement.

11. A grid mesh anchor assembly as claimed in claim 1 wherein the flexible coupling member is in the form of a flexible rope, wire or cable.

12. A grid mesh anchor assembly as claimed in claim 1 wherein the flexible coupling member is capable of attaching to a safety fall device.

13. A grid mesh anchor assembly as claimed in claim 12 wherein said grid mesh anchor assembly is rated to 22.2 kN (5000 lbs) as a personal fall arrest anchorage.

14. A grid mesh anchor assembly as claimed in claim 1 wherein the flexible coupling member is capable of attaching to a lifting device.

* * * * *